US007143629B1

(12) United States Patent
Chiu

(10) Patent No.: US 7,143,629 B1
(45) Date of Patent: Dec. 5, 2006

(54) MANUAL PIPE BENDER

(76) Inventor: Ching-Su Chiu, No. 327, Peng Yi Rd., Taiping City, Taichung Hsien (TW)

( * ) Notice: Subject to any disclaimer, the term of this patent is extended or adjusted under 35 U.S.C. 154(b) by 57 days.

(21) Appl. No.: 11/302,265

(22) Filed: Dec. 14, 2005

(51) Int. Cl.
*B21D 11/04* (2006.01)
*B21D 7/04* (2006.01)

(52) U.S. Cl. ..... 72/459; 72/154; 72/217; 72/388

(58) Field of Classification Search ..... 72/149, 72/154, 217, 216, 458, 459, 388
See application file for complete search history.

(56) References Cited

U.S. PATENT DOCUMENTS 1,075,837 A * 10/1913 Malo et al. ..... 72/459
1,247,729 A * 11/1917 Scribner ..... 72/459
1,640,426 A * 8/1927 Pike ..... 72/458
2,979,976 A * 4/1961 Franck ..... 72/388
3,190,105 A * 6/1965 Strybel ..... 72/459
3,785,190 A * 1/1974 Schall et al. ..... 72/149
3,906,778 A * 9/1975 Crouse ..... 72/459
4,827,755 A * 5/1989 Strybel ..... 72/458
6,463,780 B1 * 10/2002 Kalanish ..... 72/388
6,609,405 B1 * 8/2003 Bates et al. ..... 72/459
6,883,360 B1 * 4/2005 Bates et al. ..... 72/459

* cited by examiner

*Primary Examiner*—David Jones
(74) *Attorney, Agent, or Firm*—Bacon & Thomas

(57) ABSTRACT

The manual pipe bender has a stationary handle, a head, a bending die, a bending lever, and a bending handle. The stationary handle has a distal end, and the head is attached to the stationary handle. The bending die has a bending surface and multiple ratchet teeth. The bending lever attaches the bending die rotatably to the head. The bending handle is attached to and rotates the bending die around the head and has a drive bracket that engages a selected ratchet tooth on the bending die to keep the handles from crossing. Consequently, bending acute angles in pipes is convenient.

2 Claims, 7 Drawing Sheets

MANUAL PIPE BENDER

BACKGROUND OF THE INVENTION

1. Field of the Invention

The present invention relates to a pipe bender, and more particularly to a manual pipe bender to bend metal pipe, which is easily operated.

2. Description of Related Art

With reference to FIG. 7, a conventional manual pipe bender (80) has a stationary handle (81), a head (84), a bending handle (82) and a bending lever (85).

The stationary handle (81) has a distal end and a pipe grip (83). The pipe grip (83) is formed on the distal end of the stationary handle (81) and holds a pipe securely in the manual pipe bender (80).

The head (84) is essentially a thick disk, is attached to the stationary handle (81), corresponds to the pipe grip (83) and has a center, an outer edge, a central pivot hole and a pipe groove. The central pivot hole is formed through the center of the head (84). The pipe groove is formed in the outer edge of the head (84) and corresponds to the pipe grip (83).

The bending handle (82) is attached pivotally to and presses against the head (84) and has a distal end and a bending die. The bending die is attached to the distal end of the bending handle (82), abuts the outer edge of the head (84), presses against a pipe in the bending groove and has a transverse pivot hole and a bending surface. The transverse pivot hole is formed through the bending die. The bending surface slidably presses against the outer edge of the head (84) and bends a pipe in the bending groove when the bending handle (82) is pulled.

The bending lever (85) is connected pivotally to the head (84) and the bending die and has a proximal end, a distal end and two mounting pins. The proximal end is attached pivotally to on the center of the head (84). The distal end is attached pivotally to the bending die. The mounting pins are attached respectively to the proximal and distal ends of the bending lever (85) and are mounted rotatably respectively in the central hole through the head (84) and the transverse hole through the bending die.

Even though the conventional manual pipe bender (80) can bend pipe, the conventional manual pipe bender (80) has the following shortcoming.

To bend acute angles in pipes, the handles (81, 82) must cross. Therefore, operation of the conventional pipe bender (80) is very awkward when bending pipes to acute angles.

SUMMARY OF THE INVENTION

The main objective of the present invention is to provide a manual pipe bender that can conveniently bend acute angles in pipes.

The manual pipe bender has a stationary handle, a head, a bending die, a bending lever, and a bending handle. The stationary handle has a distal end, and the head is attached to the stationary handle. The bending die has a bending surface and multiple ratchet teeth. The bending lever attaches the bending die rotatably to the head. The bending handle is attached to and rotates the bending die around the head and has a drive bracket that engages a selected ratchet tooth on the bending die to keep the handles from crossing. Consequently, bending acute angles in pipes is convenient.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
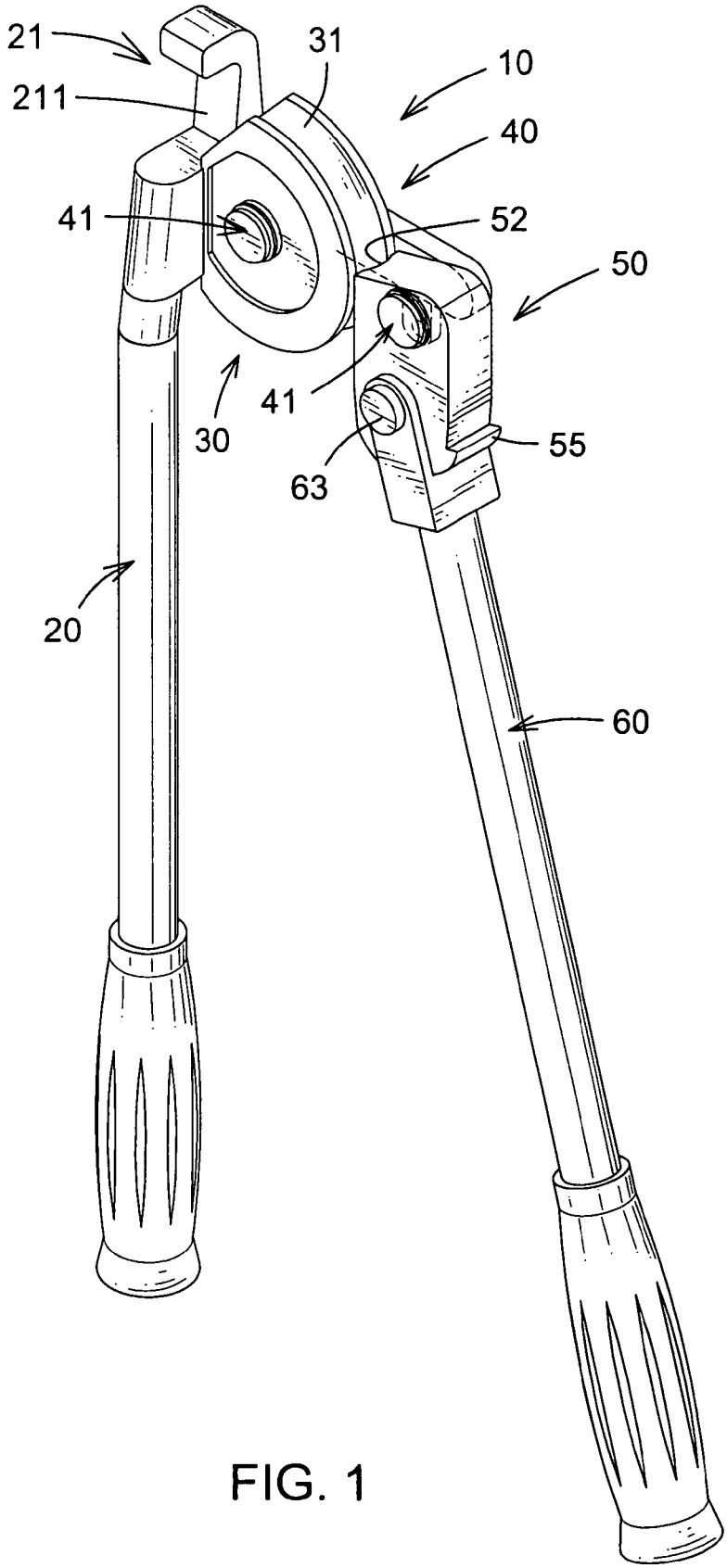
FIG. 1 is a perspective view of a manual pipe bender in accordance with the present invention.
Figure 2:
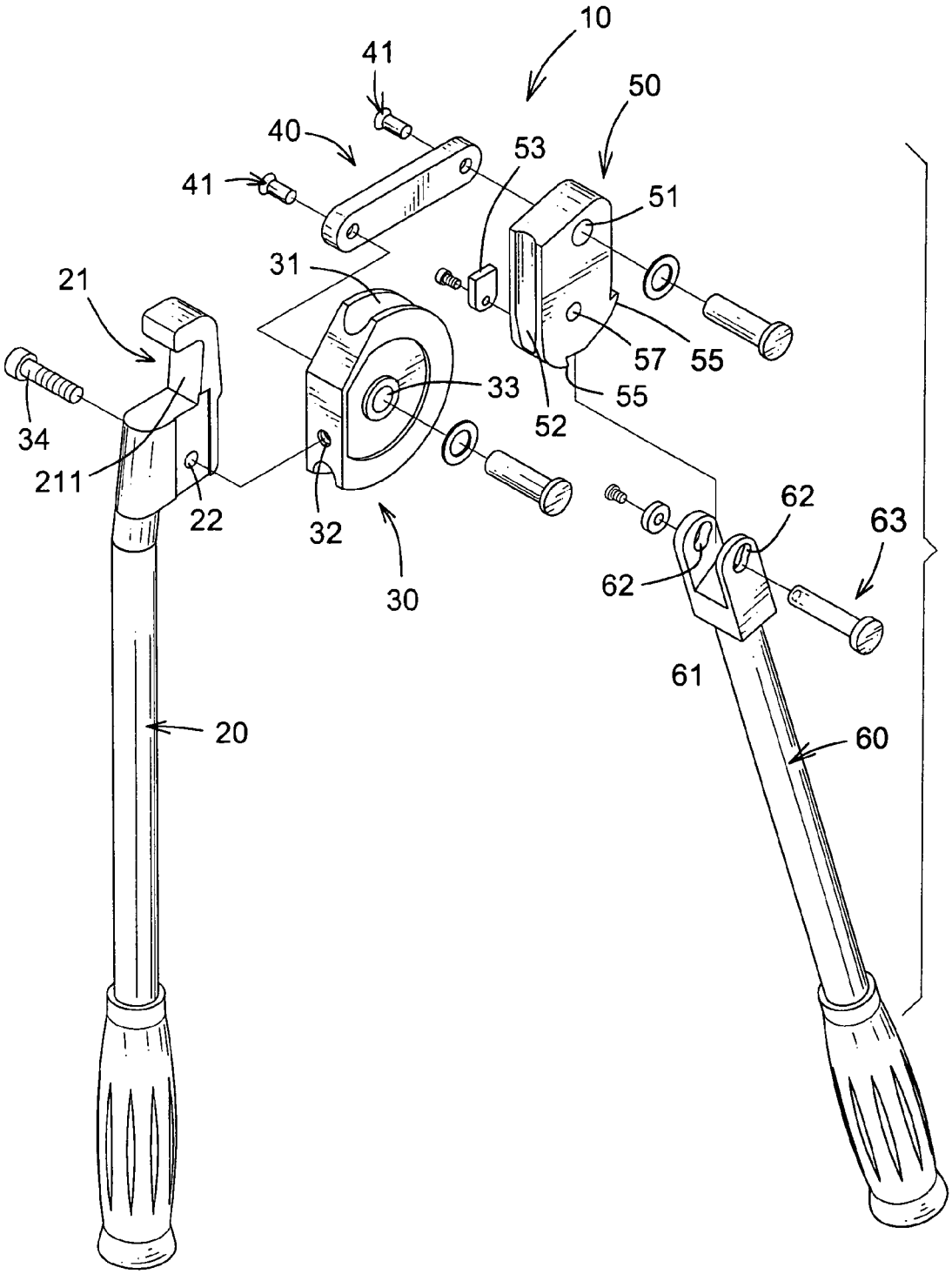
FIG. 2 is an exploded perspective view of the manual pipe bender in FIG. 1.
Figure 3:
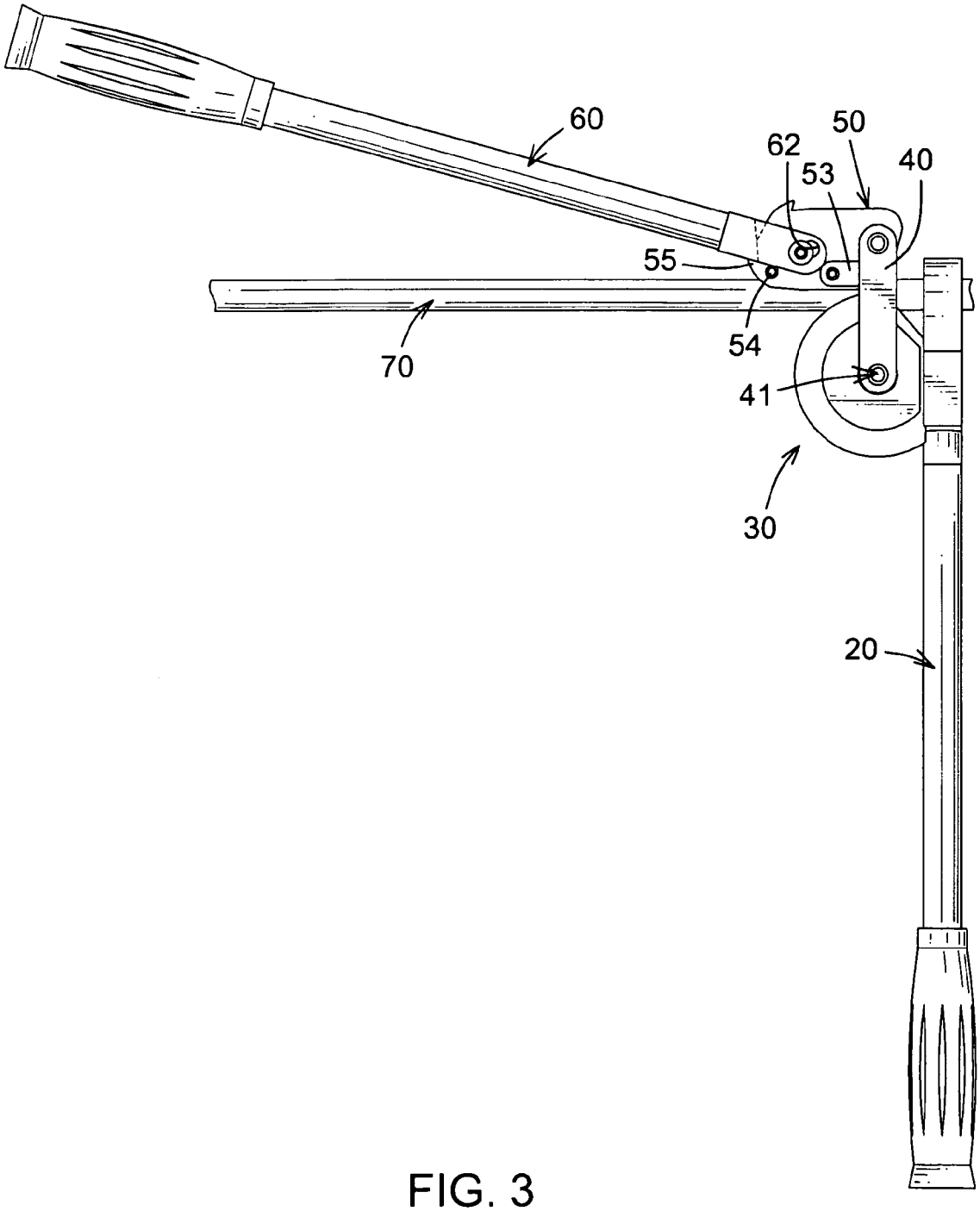
FIG. 3 is an operational side view of the manual pipe bender in FIG. 1 with a pipe in the manual pipe bender ready to be bent.

With reference to FIGS. 1, 2 and 3, a manual pipe bender (10) in accordance with the present invention comprises a stationary handle (20), a head (30), a bending die (50), a bending lever (40) and a bending handle (60).

The stationary handle (20) comprises a distal end and a pipe grip (21). The pipe grip (21) is formed on the distal end of the stationary handle (20) and has a front, a rear, an optional through hole (22) and an optional mounting recess (221). The through hole (22) is formed through the pipe grip (21) from the front to the rear. The mounting recess (221) is formed in the front of the pipe grip (21).

The head (30) is attached securely to distal end of the stationary handle (20) and has a curved outer edge, a center, a flat mounting surface, an optional attachment hole (32), an optional head fastener (34), a pipe groove (31) and a central pivot hole (33). The flat mounting surface is connected securely to the front of the pipe grip (21) and is mounted in the mounting recess (221) in the front of the pipe grip (21). The attachment hole (32) is formed in the flat mounting surface of the head (30) and corresponds to the through hole (22) in the pipe grip (21). The head fastener (34) extends through the through hole (22) in the pipe grip (21) into the attachment hole (32) to hold the head (30) securely on the pipe grip (21). The pipe groove (31) is formed in the curved outer edge of the head (30) so a pipe (70) passing through and held by the pipe grip (21) is held in the pipe groove (31) to be bent. The central pivot hole (33) is formed through the center of the head (30).

Figure 4:
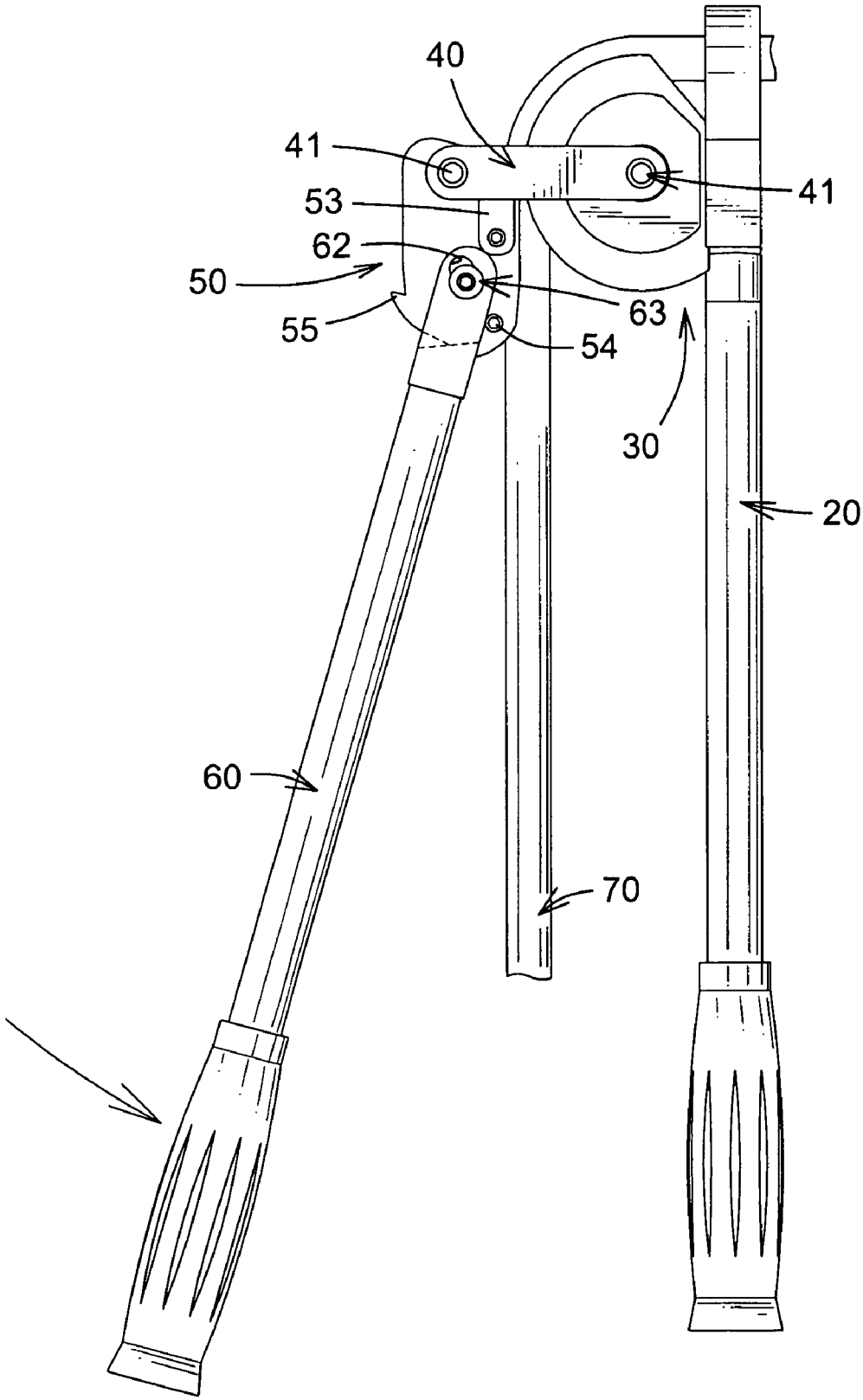
FIG. 4 is an operational side view of the manual pipe bender in FIG. 1 with a pipe in the manual pipe bender bent a first increment.

The bending die (50) is attached pivotally to and presses against the head (30), abuts the outer edge of the head (30), presses against a pipe (70) in the bending groove of the head (30) and has a bending surface, a proximal end, a distal end, two sides, a transverse pivot hole (51), a bending groove (52), a positive stop (54), a lever lock (53), a transverse drive hole (57) and multiple ratchet teeth (55). The bending surface presses against the outer edge of the head (30). The proximal end is curved and has an outer surface. The transverse pivot hole (51) is formed through the bending die (50) near the distal end. With further reference to FIG. 4, the bending groove (52) is defined in the bending surface and presses against and bends a pipe (70) in the bending groove (31) in the head (30) when the bending die (50) is pulled down. The positive stop (54) is formed on and protrudes out from one side of the bending die (50) near the proximal end and bending surface of the bending die (50). The lever lock (53) is mounted pivotally on one side of the bending die (50) between the positive stop (54) and the transverse pivot hole (51). The transverse drive hole (57) is formed through the bending die (50) between the lever lock (53) and the positive stop (54). The ratchet teeth (55) are formed on and protrude from the proximal end of the bending die (50). An initial ratchet tooth (55) is aligned with the positive stop (54). Subsequent ratchet teeth (55) are separated from adjacent ratchet teeth (55).

The bending lever (40) is connected pivotally to the head (30) and the bending die (50), abut the lever lock (53) to keep the bending die (50) from pivoting relative to the bending lever (40) and has a proximal end, a distal end, two through holes and two mounting pins (41). The proximal end is attached pivotally to the center of the head (30). The through holes are formed through the bending lever (40) respectively near the proximal and distal ends. A first mounting pin (41) of the bending lever (40) extends through the central pivot hole (33) in the head (30) and the through hole in the bending lever (40) near the proximal end to pivotally connect the bending lever (40) to the head (30). A second mounting pin (41) extends through the transverse pivot hole (51) in the bending die (50) and the through hole in the bending lever (40) near the distal end to pivotally connect the bending die (50) to the bending lever (40) and hold the bending surface of the bending die (50) against the outer edge of the head (30).

Figure 5:
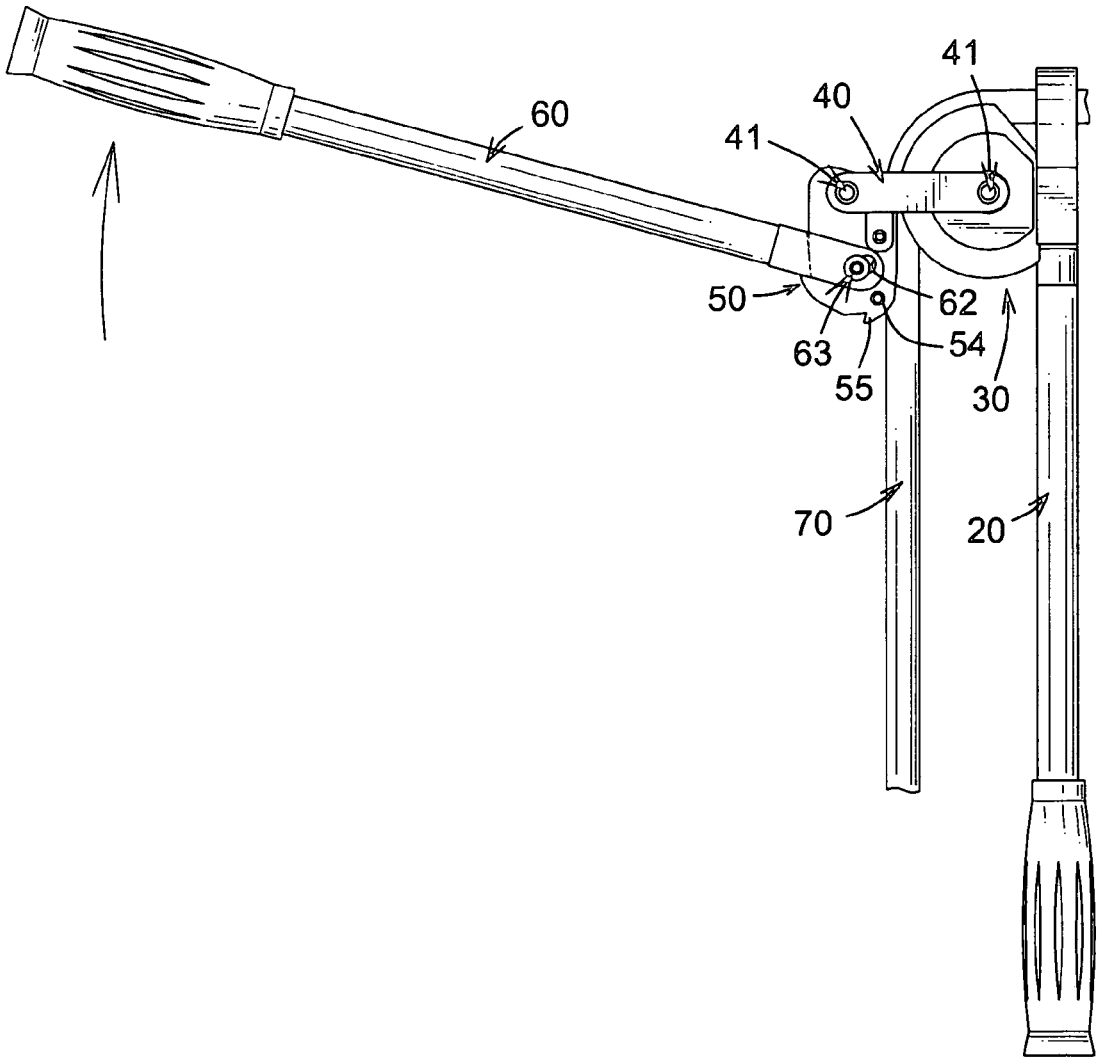
FIG. 5 is an operational side view of the manual pipe bender in FIG. 1 configured to bend a pipe a second increment.
Figure 6:
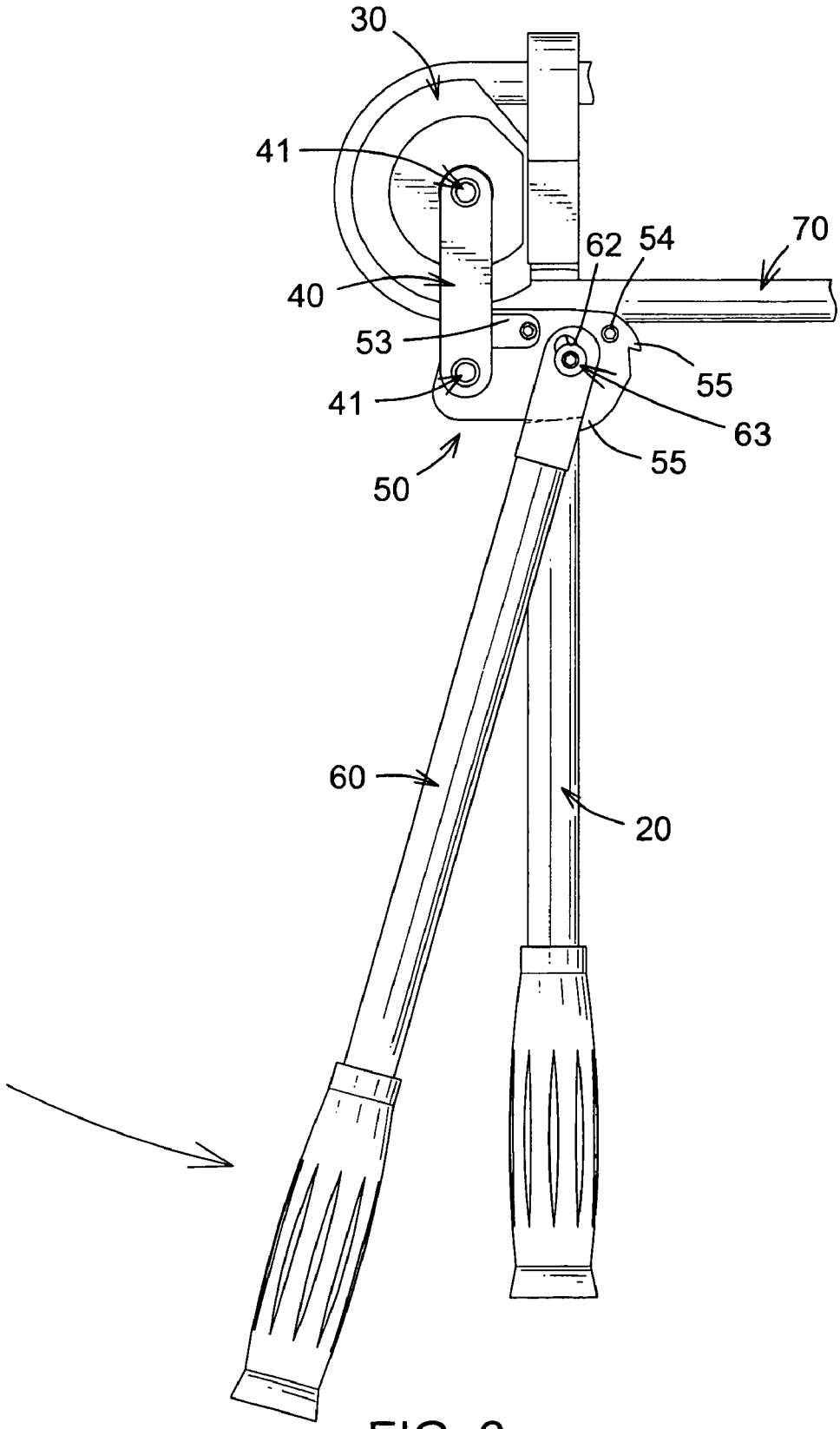
FIG. 6 is an operational side view of the manual pipe bender in FIG. 1 with a pipe in the manual pipe bender bent a second increment.
Figure 7:
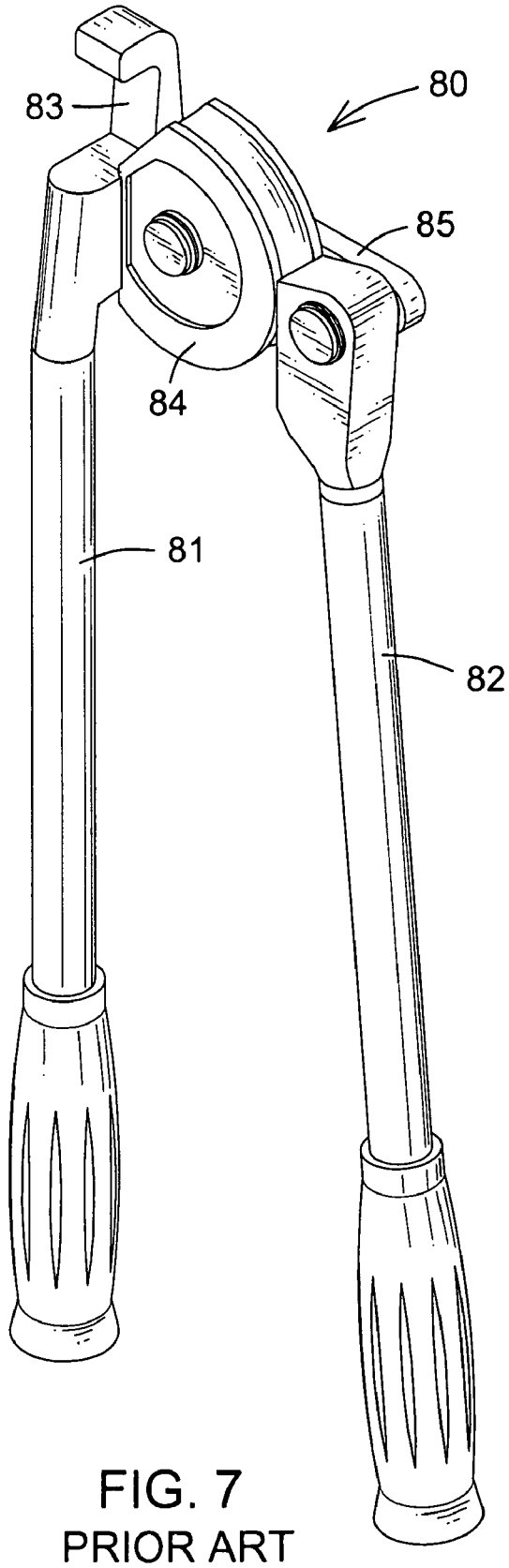
FIG. 7 PRIOR ART
FIG. 7 is a perspective view of a conventional pipe bender in accordance with the prior art.

The bending handle (60) is attached to and rotates the bending die (50) around the head (30) and has a distal end, a drive bracket (61) and a drive pin (63). The drive bracket (61) is U-shaped, is formed on and protrudes from the distal end of the bending handle (60), engages and rotates the bending die (50) to bend a pipe (70) in the pipe groove (31) in the head (30) and has two arms and a pawl. The arms extend from the distal end of the bending handle (60) in parallel, and each arm has a distal end and an elongated through hole (62). Each elongated hole (62) is formed through the arm near the distal end. The pawl is formed between the arms and selectively engages one of the ratchet teeth (55) so the bending handle (60) can rotate the bending die (50). The drive pin (63) is mounted through the elongated through holes (62) in the arms and the transverse drive hole (57) in the bending die (50) and pivotally attaches the bending handle (60) to the bending die (50). With further reference to FIGS. 5 and 6, the elongated through holes (62) slide on the drive pin to release the pawl from the ratchet teeth (55) and slide again so the pawl engages a selected ratchet tooth (55).

The advantage of the pipe bender (10) follows.

The multiple ratchet teeth (55) formed on the bending die (50) allow the pipe bender (10) to bend a pipe (70) as much as 180° without having the bending handle (60) and the stationary handle (20) crossing. During a bending operation, the pawl on the drive bracket (61) is released from a ratchet tooth (55) and moved to the next ratchet tooth (55) when the bending handle (60) approaches the stationary handle (20). Consequently, operation of the manual pipe bender (10) is convenient even when bending acute angles in pipes (70).

Even though numerous characteristics and advantages of the present utility model have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pipe bender comprising a stationary handle comprising
- a distal end; and
- a pipe grip formed on the distal end of the stationary handle and having
  - a front; and
  - a rear;

a head attached securely to distal end of the stationary handle and having
- a curved outer edge;
- a center;
- a flat mounting surface connected securely to and protruding from the front of the pipe grip;
- a pipe groove formed in the curved outer edge of the head; and
- a central pivot hole formed through the center of the head;

a bending die attached pivotally to and pressing against the head, abutting the outer edge of the head for pressing against a pipe in the bending groove of the head and having;
- a bending surface pressing against the outer edge of the head;
- a proximal end being curved and having an outer surface;
- a distal end;
- two sides;
- a transverse pivot hole formed through the bending die near the distal end;
- a bending groove defined in the bending surface;
- a positive stop formed on and protruding out from one side of the bending die near the proximal end and bending surface of the bending die;
- a lever lock mounted rotatably on one side of the bending die between the positive stop and the transverse pivot hole;
- a transverse drive hole formed through the bending die between the lever lock and the positive stop; and
- multiple ratchet teeth formed on and protruding from the proximal end of the bending die with an initial ratchet tooth being aligned with the positive stop and subsequent ratchet teeth separated from adjacent ratchet teeth;

a bending lever connected rotatably to the head and the bending die, abutting the lever lock to keep the bending die from pivoting relative to the bending lever and having
- a proximal end attached rotatably to the center of the head;
- a distal end;
- two through holes formed through the bending lever respectively near the proximal and distal ends of the bending lever with a first mounting pin extending through the central pivot hole in the head and the through hole in the bending lever near the proximal end to pivotally connect the bending lever to the head, and a second mounting pin of the bending lever extending through the transverse pivot hole in the bending die and the through hole in the bending lever near the distal end to pivotally connect the bending die to the bending lever and hold the bending surface of the bending die against the outer edge of the head; and a bending handle attached to and pivotally connected to the bending die around the head and having a distal end;

a drive bracket being U-shaped, formed on and protruding from the distal end of the bending handle, engaging and rotating the bending die to bend a pipe in the pipe groove in the head and has two and having two arms extending from the distal end of the bending handle in parallel, and each arm having a distal end; and an elongated through hole formed through the arm near the distal end;

a pawl formed between the arms and selectively engaging one of the ratchet teeth; and a drive pin mounted through the elongated through holes in the arms and the transverse drive hole in the bending die and pivotally attaching the bending handle to the bending die;

wherein the elongated through holes slide on the drive pin to release the pawl from the ratchet teeth and slide again so the pawl engages a selected ratchet tooth.

2. The manual pipe bender as claimed in claim 1, wherein the pipe grip on the stationary handle further has a through hole formed through the pipe grip from the front to the rear; and a mounting recess formed in the front of the pipe grip;

the head further has an attachment hole formed in the flat mounting surface of the head and corresponding to the through hole in the pipe grip; and a head fastener extending through the through hole in the pipe grip into the attachment hole to hold the head securely on the pipe grip; and the flat mounting surface of the head is mounted in the mounting recess in the front of the pipe grip.

* * * * *